US009869153B2

(12) United States Patent
Moreno et al.

(10) Patent No.: US 9,869,153 B2
(45) Date of Patent: Jan. 16, 2018

(54) REMOTELY CONTROLLABLE VALVE FOR WELL COMPLETION OPERATIONS

(71) Applicant: Halliburton Energy Services, Inc., Houston, TX (US)

(72) Inventors: Bernardo Alfonso Moreno, Houston, TX (US); John Patrick O'Hara, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 520 days.

(21) Appl. No.: 14/277,088

(22) Filed: May 14, 2014

(65) Prior Publication Data

US 2015/0330188 A1 Nov. 19, 2015

(51) Int. Cl.

| | |
|---|---|
| ***E21B 33/124*** | (2006.01) |
| ***E21B 34/10*** | (2006.01) |
| ***E21B 43/08*** | (2006.01) |
| ***E21B 47/06*** | (2012.01) |
| ***E21B 43/12*** | (2006.01) |
| ***E21B 43/16*** | (2006.01) |
| ***E21B 34/06*** | (2006.01) |
| *E21B 34/00* | (2006.01) |

(52) U.S. Cl.

CPC ..... *E21B 33/124* (2013.01); *E21B 34/06* (2013.01); *E21B 34/10* (2013.01); *E21B 43/08* (2013.01); *E21B 43/12* (2013.01); *E21B 43/16* (2013.01); *E21B 47/06* (2013.01); *E21B 34/066* (2013.01); *E21B 47/065* (2013.01); *E21B 2034/007* (2013.01)

(58) Field of Classification Search

CPC ..... E21B 33/124; E21B 34/06; E21B 43/12; E21B 47/06; E21B 43/16; E21B 43/08; E21B 34/10; E21B 2034/007; E21B 34/066; E21B 47/065

See application file for complete search history.

(56) References Cited

U.S. PATENT DOCUMENTS 6,464,011 B2 * 10/2002 Tubel ..... E21B 34/066 166/313
8,240,382 B2 * 8/2012 Krush ..... E21B 43/04 166/278
9,163,488 B2 * 10/2015 Tips ..... E21B 43/08
(Continued)

OTHER PUBLICATIONS

Schlumberger Oilfield Glossary entries for "gravel pack screen", "gravel pack", and "sand control", accessed Mar. 15, 2017 via www.glossary.oilfield.slb.com.*

*Primary Examiner* — Blake E Michener
(74) *Attorney, Agent, or Firm* — Benjamin Fite; Baker Botts L.L.P.

(57) ABSTRACT

An example tubing string may at least partially define an internal bore. The tubing string may include an expandable packer and a permeable barrier. The tubing string may further include a remotely-controllable valve responsive to at least one downhole trigger condition, such as a downhole pressure or temperature condition. The remotely-controllable valve may provide selective fluid communication through the permeable barrier between the internal bore and an annulus outside of the permeable barrier. The remotely-controllable valve may function as at least one of a fluid-loss control valve in a completion string assembly or a circulation valve about a completion string assembly.

24 Claims, 4 Drawing Sheets

(56) References Cited

U.S. PATENT DOCUMENTS

| | | | | |
|---|---|---|---|---|
| 2001/0013412 | A1* | 8/2001 | Tubel | E21B 34/066<br>166/250.01 |
| 2001/0030049 | A1* | 10/2001 | Patel | E21B 23/006<br>166/386 |
| 2003/0111224 | A1* | 6/2003 | Hailey, Jr. | E21B 34/06<br>166/278 |
| 2007/0227731 | A1* | 10/2007 | Contant | E21B 34/06<br>166/278 |
| 2009/0008078 | A1* | 1/2009 | Patel | E21B 34/10<br>166/50 |
| 2012/0199346 | A1* | 8/2012 | Patel | E21B 43/08<br>166/278 |
| 2013/0186639 | A1* | 7/2013 | Zhao | E21B 34/08<br>166/373 |
| 2014/0083675 | A1* | 3/2014 | Grigsby | E21B 43/04<br>166/65.1 |
| 2014/0083690 | A1* | 3/2014 | Tips | E21B 43/08<br>166/250.15 |
| 2014/0083714 | A1* | 3/2014 | Grigsby | E21B 43/10<br>166/373 |

* cited by examiner

REMOTELY CONTROLLABLE VALVE FOR WELL COMPLETION OPERATIONS

BACKGROUND

During completion operations in hydrocarbon wells, different types of fluids may be pumped downhole into a completion string. Each of the fluids may serve a certain purpose within the operation and may be needed only at certain areas of the comprise string at certain times. Selective use of the fluids typically require circulation operations and selective isolation of segments of the completion string as well as selective isolation of an annulus outside of the completion string. Slurry, for example, may be pumped into a completion string to pack an annulus around the completion string with gravel or sand and/or to fracture the surrounding formation. After the gravel pack or fracturing has taken place, it may be necessary to prevent fluids in the annulus and formation from entering the completion string until hydrocarbon production is desired. In another example, a first type of fluid may be pumped into the completion string to perform a certain task, and that fluid may need to be circulated out of the completion string before further operations can commence. Typically, the circulation operations and the selective isolation of segments of the completion are accomplished by introducing a tool into the completion string that manually moves one or more sleeves to prevent or allow fluid communication between elements of the completion string.

FIGURES

Some specific exemplary embodiments of the disclosure may be understood by referring, in part, to the following description and the accompanying drawings.

Figure 1:
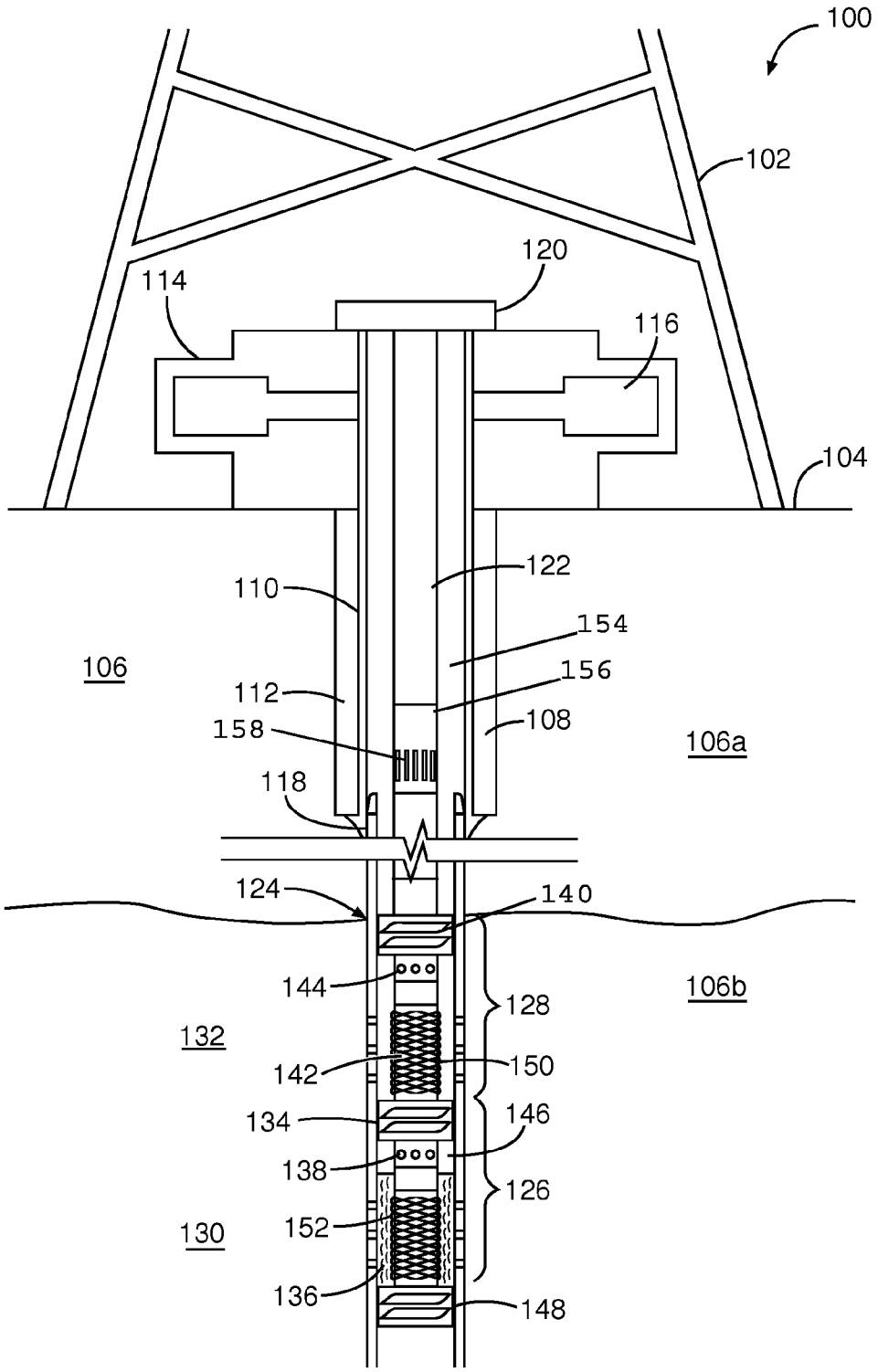
FIG. 1 is a diagram illustrating an example completion system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling and hydrocarbon recovery operations and, more particularly, to a remotely-controllable valve for well completion systems.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing. Any one of the computer readable media mentioned above may store a set of instruction that, when executed by a processor communicably coupled to the media, cause the processor to perform certain steps of actions.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Additionally, the term "upstream" refers to a direction farther from the bottom or end of the wellbore, whether it be vertical, slanted, or horizontal; and the term "downstream" refers to a direction closer to the bottom or end of the wellbore, whether it be vertical, slanted, or horizontal.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Thus, if a first device communicatively couples to a second device, that connection may be through a direct connection, or through an indirect communication connection via other devices and connections. The indefinite articles "a" or "an," as used herein, are defined herein to mean one or more than one of the elements that it introduces.

FIG. 1 is a diagram of an example completion system 100, according to aspects of the present disclosure. The system 100 comprises a rig 102 located at the surface 104 of a formation 106 comprising one or more formation strata 106*a* and 106*b*. The rig 102 may be positioned above a wellbore 108 within the formation 106. The wellbore 108 may pierce one or more of the formation strata 106*a* and 106*b* that contains trapped hydrocarbons, and the completion system 100 may prepare the strata to release the trapped hydrocarbons to the surface 104. Although the wellbore 108 is depicted as a vertical well, the complete system 100 may be used with other types of wellbores, including but not limited to slanted wells, horizontal wells, multilateral wells and the like. Also, even though FIG. 1 depicts an onshore operation, similar completion systems may be used with offshore applications.

A casing 110 is at least partially disposed within the wellbore 108 and secured to the wellbore 108 with cement 112. The casing 110 may be coupled to a wellhead installation 114 that includes a blowout preventer 116. In the embodiment shown, a second casing or liner 118 is suspended from and extends below the casing 110, into a narrower portion of the wellbore 108 within strata 106*b*. The terms "liner" and "casing" are used interchangeably to describe tubular materials, which are used to form protective linings in wellbores. Liners and casings may be made from any material such as metals, plastics, composites, or the like, may be expanded or unexpanded as part of an installation procedure, and may be segmented or continuous. Additionally, it is not necessary for a liner or casing to be cemented in a wellbore.

In certain embodiments, the system 100 may further include a hoisting mechanism 120 coupled to the rig 102 for raising and lowering one or more tubing strings with the wellbore 108. Example tubing strings include working string 122 and completion string 124, individually, or combined, as well as numerous other configurations of connected tubular elements lowered into the wellbore 108 from the surface. The working string 122 may be coupled to the completion string 124, which may be permanently deployed and disposed within the wellbore 108. Although element 122 is described as a working string herein, it may also comprise a production tubing that coupled to the completion string 124 and forms a fluid channel between the completion string 124 and the surface 104. The completion string 124 may comprise one or more string assemblies that are positioned proximate and configured to isolate zones of interest within a formation. In the embodiment shown, the completion string 124 comprises a lower string assembly 126 and an upper string assembly 128 proximate two the zones of interest 130 and 132 within the strata 106*b*. In other embodiments, both the number and location of zones of interest and completion string assemblies may be different yet still within the scope of this disclosure.

String assemblies 126 and 128 may themselves comprise elongated, tubing strings that individually and collectively define and internal bore. In the embodiment shown, an internal bore of the lower string assembly 126 may be in fluid communication with an internal bore of the upper string assembly 128, which may in turn be in fluid communication with the surface 104 through working string 122. The string assemblies 126 and 128 may further comprise mechanical, electrical, and hydraulic elements used in the completion operation. In the embodiment shown, the lower string assembly 126 comprises an expandable packer 134, a permeable barrier 136, and ports 138. Similarly, the upper string assembly 128 comprises includes an expandable packer 140, a permeable barrier 142, and ports 144. The term packer should be understood to include mechanical, electrical, hydraulic, and other types of packers that would be understood by those of ordinary skill in the art in view of this disclosure, as well as other expandable mechanisms that may at least partially form a seal between a tubular or string within a borehole and the borehole wall or a casing within the borehole, The completion string 124 may define an annulus with the casing 118 that can be divided into multiple, isolated annuluses corresponding to and defined by elements of the upper and lower string assemblies 128 and 126. Lower string assembly 126, for example, at least partially defines an isolated annulus 146 bound at the upper end by the expandable packer 134 and at a lower end by a sump packer 148, which may be coupled to a lower end of the lower string assembly 126. The annulus 146 may be in fluid communication with the zone of interest 130 through perforations in the casing 118. Similarly, upper string assembly 128 at least partially defines an annulus 150 bound at an upper end by the expandable packer 140 and at a lower end by the expandable packer 134. The annulus 150 also may be in fluid communication with the zone of interest 132 through perforations in the casing 118.

Once completion operations are finished, hydrocarbons may be "produced" from the strata 106*b* at the zones of interest 130 and 132. Specifically, the hydrocarbons may flow into the annuluses 146 and 150 and then into the internal bores of the string assemblies 126 and 128 through the respective permeable barriers 136 and 142, where the hydrocarbons will be transmitted to the surface through production tubing. Certain formation strata, however, may comprise small particulates that may reduce the flow of hydrocarbons into the completion string 124. In those instances, the annuluses 146 and 150 may be packed with gravel pumped through the completion string 124 into annuluses 146 and 150 in the form of a slurry. The slurry may exit through the ports 138 and 144 and set within the annuluses 146 and 150. FIG. 1 illustrates a gravel pack 152 within the annulus 146. Once set, the gravel may operate in conjunction with the permeable barriers 136 and 142 to ensure sufficient hydrocarbon flow. In certain embodiments, the slurry may be used to fracture the formation in addition to maintaining a sufficient flow of hydrocarbons.

In typical operations, the slurry may be pumped into the lower string assembly 126 first, then into the upper string assembly 128. After the slurry is pumped into the lower string assembly 126, it may be necessary to isolate the annulus 146 from the internal bores of the string assemblies 126 and 128, to prevent the flow of formation fluids until hydrocarbon production is desired. Isolating the annulus 146 may comprise closing the ports 138 using a tool introduced into the lower string assembly 126 through the internal bore of the lower portion 126, and preventing fluid from entering the internal bore of the lower string assembly 126 through the permeable barrier 136. According to aspects of the present disclosure, and as will be described in detail below, the lower string assembly 126 may comprise a remotely-controllable valve responsive to at least one downhole trigger condition that may selectively prevent and allow fluid communication between the internal bore of the lower string assembly 126 and the annulus 146 through the permeable barrier 136. In this configuration, the remotely-controllable valve may function as a fluid loss control valve (FLCV) that prevents unwanted fluid losses from the formation to the surface while completion operations are underway.

In certain embodiments, remotely-controllable valves responsive to at least one downhole trigger conditions may be incorporated into other portions of the completion system 100. In the embodiment shown, the packer 140 of the upper string assembly 128 may be the highest packer within the completion string 124, such that it isolates annuluses 146 and 150 from an annulus 154 that extends from the upper string assembly 128 to the surface 104. In the embodiment shown, a remotely-controllable valve 156 may be coupled to completion string 124 above the packer 140, such that it provides selective fluid communication between the interior bore of the working string 122 or production tubing and the annulus 154 through a permeable barrier 158, shown as vertical slots within an outer housing of the valve 154 in FIG. 1. In this configuration, the valve 154 may comprise a circulation valve that may be actuated based on one or more downhole trigger conditions to allow fluids within the working string 122 to be circulated to the surface 104 through the annulus 154 without impacting the upper and lower string segments 126 and 128. For example, a "packer" fluid may be pumped downhole to expand the packer 140. This packer fluid may be different, for example, than the slurry used to fill the annuluses 146 and 150. When the valve 154 is open, the slurry or a different type of fluid may be pumped into the internal bore of the working string 122 at the surface, forcing the packer fluid through the barrier 158 and into the annulus 154, where it may be collected at the surface.

According to aspects of the present disclosure, downhole trigger conditions may comprise temperature and pressure conditions within the wellbore 108, which may either be naturally occurring or surface-applied. For example, remotely-controllable valves within the completion system 100 may respond to ambient pressures or temperatures within the wellbore 108 or a pressure pulse with a defined amplitude and duration generated at the surface 104 in fluids flowing downhole within the internal bore of the working string 122 and completion string 124. Advantageously, the trigger conditions may be selected so that the remotely-controllable valves will not actuate in response to pressure and temperature conditions generated downhole as part of other completion operations. In embodiments where multiple remotely-controllable valves are used, each may respond to a different trigger conditions, so that the valves may be individually actuated. Additionally, because the valves are remotely-controllable, they may be triggered without the use of separate communications pathways to the surface, or the use of mechanical tools that must be introduced into the completion string 124 from the surface.

Figure 2:
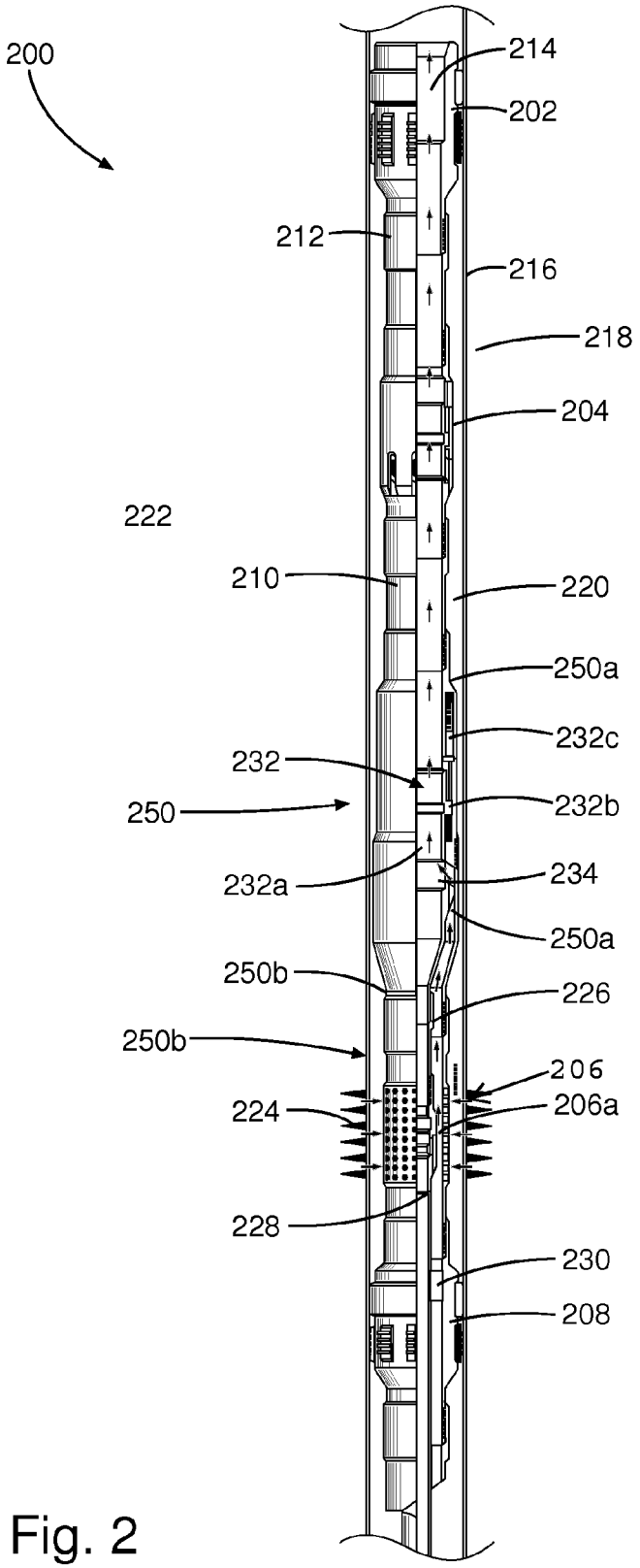
FIG. 2 is a diagram illustrating an example string assembly, according to aspects of the present disclosure.

FIG. 2 is a diagram illustrating an example lower string assembly 200 comprising a remotely-controllable valve in a FLCV configuration, according to aspects of the present disclosure. Like the lower string assembly described above, the lower string assembly 200 comprises a tubing string with an expandable packer 202, ports 204, permeable barrier 206, and sump packer 208. In the embodiment shown, each of the expandable packer 202, ports 204, permeable barrier 206, and sump packer 208 are incorporated into separate segments of the tubing string that, along with blank tubing segments 210 and 212, are coupled together at threaded or other mechanical connections to collectively form an internal bore 214 with the lower string assembly 200. The internal bore 214 may extend throughout the lower string assembly 200, providing a fluid communication channel from an upper string assembly above the lower string assembly 200 to other elements located below the lower string assembly 200. It should be appreciated, however, that segments of the string assembly 200 may be arranged differently, combined into one or more different segments, and/or manufactured as a single unit, rather than segments that are threaded together.

An isolated annulus 220 is formed when the expandable packer 202 and the sump packer 208 are expanded to contact and seal against the casing 218. The expandable packer 202 and sump packer 202 may be extended, for example, using hydraulic fluid or another mechanism that would be appreciated by one of ordinary skill in the art in view of this disclosure. Although an expandable packer and sump packer are shown, other expandable sealing assemblies may be used instead of the expandable packer 202 and sump packer 208. As described above, the annulus 220 may be in fluid communication with a formation 222 through one or more perforations 224 in the casing 216.

The string assembly 200 may further comprise a remotely-controllable valve segment 250, which, in the embodiment shown, comprises an outer tubular 250*a* that is coupled between the permeable barrier 206 and the expandable packer 202, and an inner tubular 250*b* coupled to an inner string 228 that is at least partially disposed within the permeable barrier 206. The inner string 228 may comprise an elongated tubular with a diameter smaller than the diameter of the permeable barrier 206 and may at least partially defines an inner annulus 226 within the lower string assembly 200. In the embodiment shown, the inner annulus 226 is further defined by the permeable barrier 206, a lower seal 230 in the sump packer 208, and the inner tubular 250*b* and outer tubular 250*a* of the FLCV segment 250.

In the embodiment shown, the permeable barrier 206 comprises a screen 206*a* that provides an open flow channel between the annulus 220 and the inner annulus 226. Other types, shapes and orientations of permeable barriers are possible, include vertical openings, as shown, in FIG. 1, circular ports, or any other shape of channel through which fluid may flow. The valve segment 250 comprises a port 234 between the inner annulus 226 and the internal bore 214. Accordingly, selective fluid communication between the annulus 220 and the internal bore 214 through the permeable barrier 206 may be provided through selective fluid communication between the inner annulus 226 and the internal bore 214.

According to aspects of the present disclosure, the valve segment 250 may comprise a remotely-controllable valve 232 proximate the port 234, which may provide selective fluid communication between the inner annulus 226 and the internal bore 214 by selectively blocking the port 234. In the embodiment shown, the remotely-controllable valve 232 comprises a valve assembly 232*a*, a hydraulic chamber 232*b*, and a control element 232*c*. The valve assembly 232*a* comprises a sleeve disposed within the internal bore 214 and axially movable by the hydraulic chamber 232*b* and control element 232*c* to open the port 234, thereby allowing fluid flow between the annulus 200 and the internal bore 214, or close the port 234, thereby isolating fluids from the annulus 220 within the inner annulus 226. Other remotely-controllable valve configurations are possible, including valves utilizing electric motors, hydraulic pumps, etc. to actuate or move a sleeve or another element in one of many directions.

The control element 232*c* may comprise sensors, electronics, and other mechanisms that control when the sleeve 232*a* is actuated. For example, the control element 232*c* may comprise a controller and at least one of a pressure sensor and a temperature sensor. The controller may comprise an information handling system such as a microcontroller with a processor and an integrated memory device containing a set of instructions that, when executed by the processor cause the processor to perform certain actions. For example, the processor may receive one or more measurements from the pressure sensor and temperature sensor, compare the received measurements to a trigger condition or threshold stored within the controller, and depending on if the downhole trigger condition is met, transmit a command to actuate the sleeve 232*a* to prevent or allow fluid communication between the annulus 220 and the internal bore 214. The downhole trigger conditions may be loaded into the controller before the lower string assembly 200 is deployed within the borehole and/or changed or updated once the lower string assembly 200 is deployed.

In certain embodiments, the assembly 200 may be adapted for use as a circulation valve, as described above with reference to FIG. 1. For example, instead of the valve segment 250 being coupled at an upper end to blank tubing segments 210 and 216, packer 202, and ports 204, the tubing string in one embodiment may comprise the valve segment 250 coupled to production tubing or another tubing string providing fluid communication between a bore 214 within the valve segment 250 and the surface. In that configuration, the packer 208 may comprise the upper packer of an upper completion string assembly and the annulus 220 may extend to the surface. As described above, when the remotely-controllable valve 232 is open, fluid communication may be provided between a bore 214 of the valve segment 250 and the annulus, allowing fluid within the bore 214 to be circulated to the surface within the annulus 220 without entering the upper and lower completion string segments. When the fluid has been sufficiently circulated, the valve 232 may be closed, such that fluid may be pumped into the upper and lower completion string assemblies without exiting through the permeable barrier 206.

Figure 3:
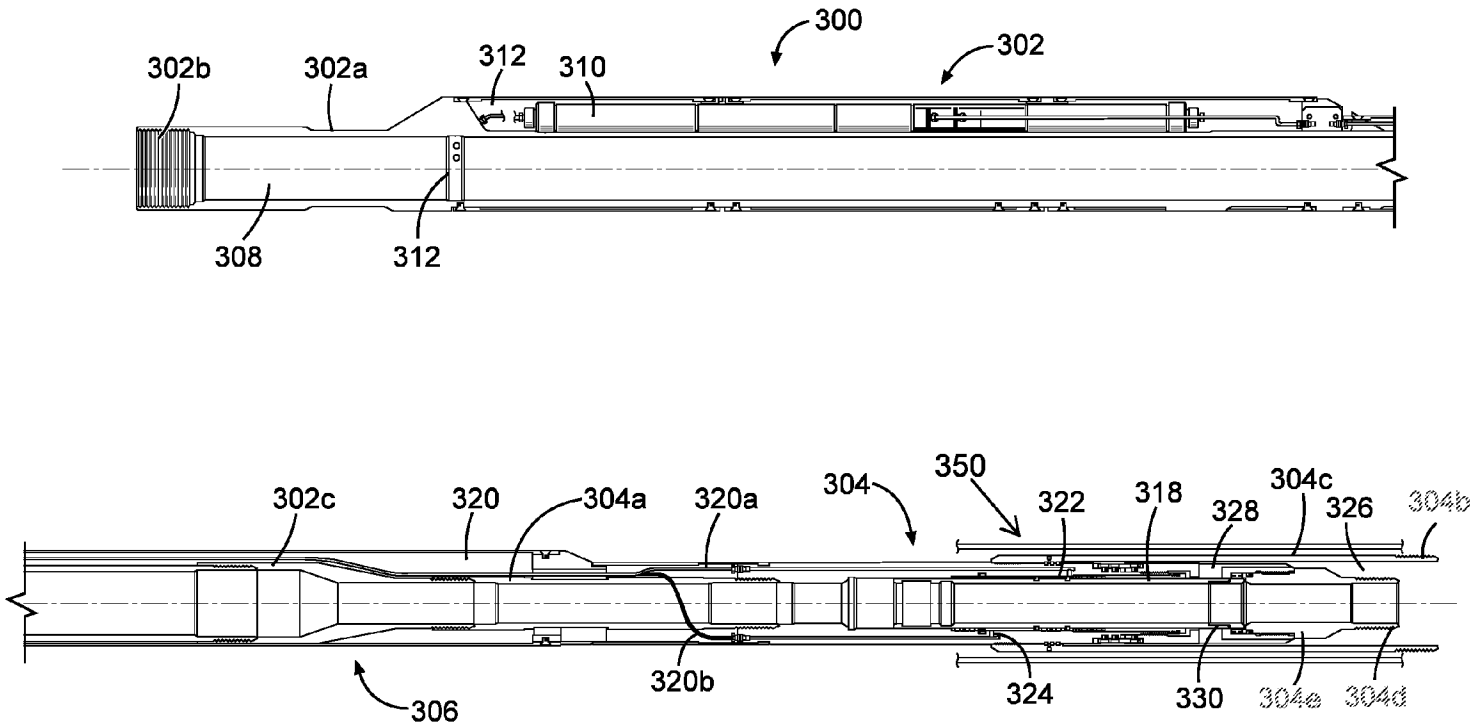
FIG. 3 is a diagram illustrating an example remotely-controllable valve, according to aspects of the present disclosure.
Figure 4:
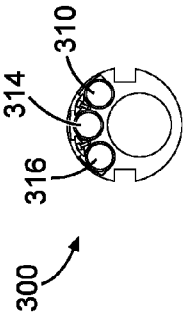
FIG. 4 is a diagram illustrating an example remotely-controllable valve, according to aspects of the present disclosure.
Figure 5:
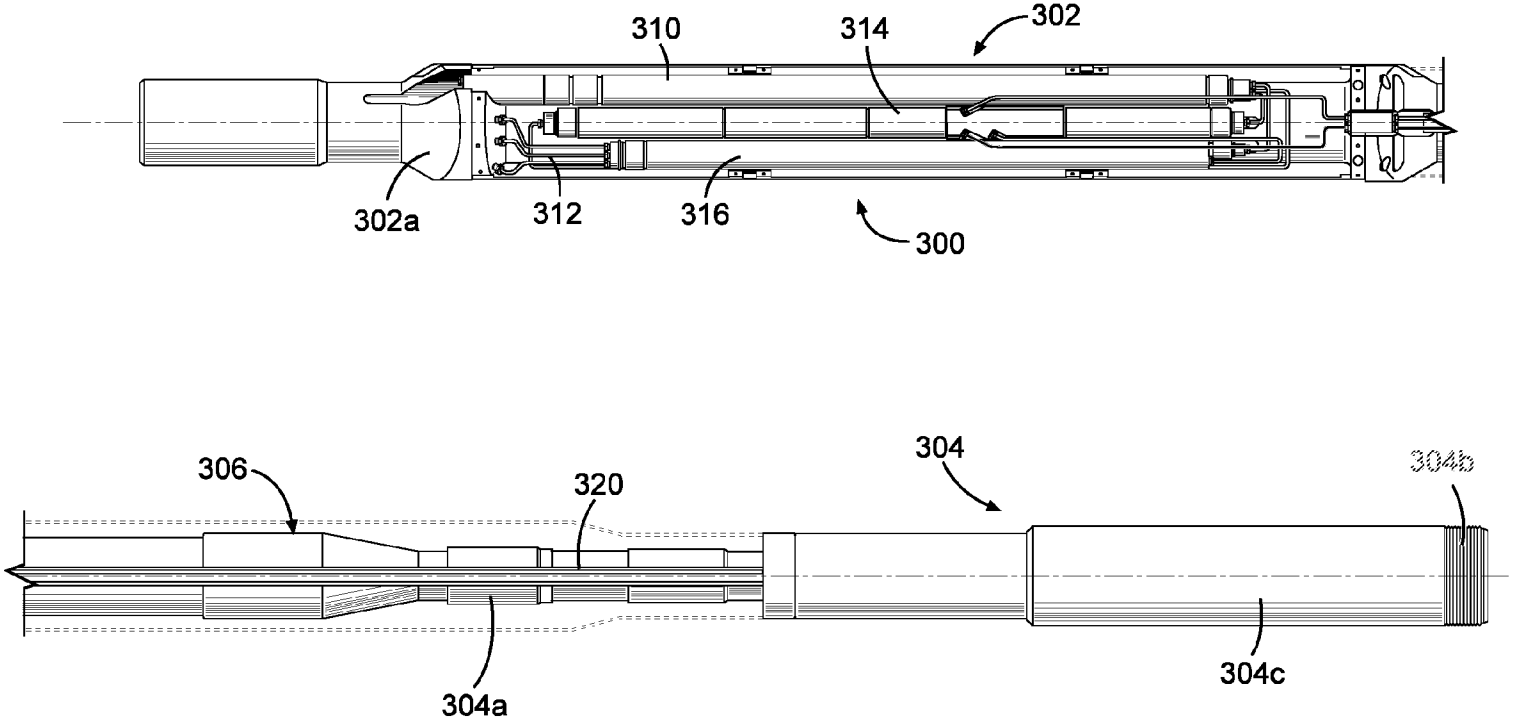
FIG. 5 is a diagram illustrating an example remotely-controllable valve, according to aspects of the present disclosure.

FIGS. 3, 4, and 5 are diagrams illustrating an example remotely-controllable valve segment 300 that may be incorporated into a tubing string as either a FLCV or a circulation valve, according to aspects of the present disclosure. The valve segment 300 may comprise an elongated, tubular element with a control section 302 and a valve section 304 coupled together through a crossover section 306 and one or more control lines 308. Specifically, the control section 302 may comprise a first tubular 302*a* with a first threaded surface 302*b* for coupling to a tubing segment, such as a completion string in the case of a circulation valve or a segment of a completion string assembly in the case of a FLCV, and a second threaded surface 302*c* for coupling to a crossover segment 306. In contrast, the valve section 304 may comprise at least three threaded surfaces: a first threaded surface 304*a* for coupling to the crossover section 306, a second threaded surface 304*b* on an outer tubular 304*c* for coupling to a permeable barrier (not shown), and a third threaded surface 304*d* on an inner tubular 304*e* for coupling to an inner string (not shown). Notably, portions of the control section 302, valve section 304, and crossover section 306 may form an internal bore 308 that at least partially forms the internal bore of a lower strings assembly with the FLCV segment 300 is so incorporated.

The control section 302 may comprise an electronics module 310, shown herein as a cylindrical insert within a notched area 312 in an expanded diameter portion of the first tubular 302*a*. The electronics module 310 may comprise the controller and a power source, for example. The notched area 312 may be covered by a plate when introduced downhole, to protect the electronics module 310 and other components within the notched area. In the embodiment shown, the electronics module 310 is communicably coupled to pressure sensors 312 that are exposed to the internal bore 308 of the valve segment 300 such that they may measure pressure conditions within the internal bore 308, some of which may comprise downhole trigger conditions. The measurements from the pressure sensors 312 may be received at the controller within the electronics module 310. In other embodiments, temperature sensors may be used in addition to the pressure sensors 312, both of which may be exposed to the internal bore 308 (as shown) or exposed to an annulus outside of the valve segment 300.

In the embodiment shown, the control section 302 further comprises pump assembly 314 and expansion chamber 316, both of which are located within the notched area 312 and both of which, in addition to the electronics module 310 and sensor 312, and valve assembly 350, may comprise elements of a remotely-controllable valve. Specifically, the pump assembly 314 and expansion chamber 316 may comprise elements of a hydraulic control assembly that may actuate the valve assembly 350 within the valve section 304 to provide selective fluid communication between an annulus outside of the valve segment 300 and the internal bore 308. The pump assembly 314 and expansion chamber 316 may be communicably coupled to and receive commands from the electronics module 310, and in particular a controller within the electronics module 310. For example, when the controller receives measurements from the pressure sensors 312 and determines that a downhole trigger condition has occurred, the controller may transmit a command to the pump assembly 314 and expansion chamber 316, which may cause the pump assembly 314 and expansion chamber 316 to engage and actuate valve assembly 350 by altering pressures within control lines 320, as will be described below.

The valve assembly 350 comprises a sleeve 318 disposed and axially movable within the inner tubular 304*d* in the valve section 304 that is coupled to the control section 302 through control lines 320. In the embodiment shown, the control lines 320 may comprise hydraulic lines coupled between the pump assembly 314 and expansion chamber 316 and one or more hydraulic chambers 322 and 324 in the inner tubular 304*d*. The position of the sleeve 318 within the inner tubular 304*d* may be altered by changing the relative pressures within the control lines 320 and chambers 322 and 324. In the embodiment shown, the control line 320*a* may comprise an "open" control line that forces the sleeve 318 towards the control segment 302 and into an open position when the pressure within the chamber 322 is increased. Conversely, the control line 320*b* may comprise a "close" control line that forces the sleeve 318 away from the control segment 302 and into a closed position when the pressure within the chamber 324 is increased. Although a hydraulic control actuation system is shown in FIGS. 3-4, other types of control systems, including electrical and mechanical control systems, are possible within the scope of this disclosure. For example, in certain embodiments, the control lines 320 may comprise electric conductors used to transmit control signals to one or more electrical actuators coupled to the sleeve 318.

Like the lower string assembly described with respect to FIG. 2, the valve segment 300 at least partially defines an inner annulus 326 between the inner tubular 304*e* and the outer tubular 304*c*, and also like the inner annulus described above, the segment 300 may include a port 328 that allows for fluid communication between the inner annulus 326 and the internal bore 308. The port 328 may through the inner tubular 304*e* proximate an end of the sleeve 318. In the embodiment shown, the sleeve 318 is in a closed position, in which the bottom of the sleeve 318 is engaged with a seal assembly 330 in the inner tubular 304*e*, thereby preventing fluid flow between the inner annulus 326 and the internal bore 308. In an open position, the sleeve 318 may disengage from the seal assembly 330, thereby providing a fluid pathway between the inner annulus 326 and the internal bore 308 through the port 328.

Although an axially moveable sleeve with a hydraulic control system is described herein. For example, the flow pathway may be provided through flow channels controlled by electrical valves that respond directly to signals from a control module. Additionally, the movement of the sleeve is not required to be axial. For example, in certain embodiments, the sleeve may be rotated to align ports within the sleeve to the ports 328 within the inner tubular 304*e*. Moreover, the valve assembly does not have to include a sleeve, as other configurations would be appreciated by one of ordinary skill in the art in view of this disclosure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces. The term "gas" is used within the scope of the claims for the sake of convenience in representing the various equations. It should be appreciated that the term "gas" in the claims is used interchangeably with the term "oil" as the kerogen porosity calculation applies equally to a formation containing kerogen that produces gas, and a formation containing kerogen that produces oil.

What is claimed is:

1. A completion string assembly, comprising:

a tubing at least partially defining an internal bore;

an expandable packer coupled to the tubing at a first segment;

an expandable sealing assembly coupled to the tubing at a second segment;

an isolated annulus formed between the expandable packer and the expandable sealing assembly, wherein the isolated annulus is in fluid communication with a formation;

a permeable barrier coupled to the tubing;

a remotely-controllable valve segment of the tubing, wherein the remotely-controllable valve segment comprises:

an outer tubular coupled between the permeable barrier and the expandable packer;

an inner tubular coupled to an inner string at least partially disposed within the permeable barrier, wherein the inner string defines an inner annulus within the completion string assembly, wherein the inner annulus is further defined by the permeable barrier, a lower seal in the expandable sealing assembly, the inner tubular and the outer tubular, and wherein the permeable barrier comprises a screen that provides an open flow channel between the isolated annulus and the inner annulus;

a port between the isolated annulus and the internal bore, wherein the port provides selective fluid communication between the isolated annulus and the internal bore through the permeable barrier by selective fluid communication between the inner annulus and the internal bore; and a plurality of remotely-controllable valves responsive to at least one downhole trigger condition to provide selective fluid communication between the internal bore and the inner annulus by selectively blocking the port, wherein at least one of the plurality of remotely-controllable valves is responsive to a different one of the at least one downhole trigger condition of a wellbore from at least one other of the plurality of remotely-controllable valves.

2. The completion string assembly of claim 1, wherein the at least one downhole trigger condition comprises at least one of a downhole pressure condition and a downhole temperature condition.

3. The completion string assembly of claim 1, wherein the at least one downhole trigger condition comprises at least a downhole pressure condition, and wherein the downhole pressure condition comprises an ambient pressure condition or a surface-applied pressure condition.

4. The completion string assembly of claim 1, wherein the at least one of the plurality of remotely-controllable valves comprises:

at least one of a pressure sensor and a temperature sensor;

a controller coupled to at least one of the pressure sensor and the temperature sensor; and a valve assembly actuatable by the controller.

5. The completion string assembly of claim 4, wherein the valve assembly comprises:

at least one of a hydraulic pump and an electric motor coupled to the controller; and a sleeve axially movable by one of the hydraulic pump and the electric motor.

6. The completion string assembly of claim 5, wherein the sleeve is within a valve segment comprising the inner tubular and the outer tubular.

7. The completion string assembly of claim 6, wherein the outer tubular, the permeable barrier, and the inner tubular further at least partially define the inner annulus; and the valve segment comprises the port.

8. The completion string of claim 5, wherein the sleeve provides selective fluid communication between the inner annulus and a tubing segment by selectively closing the port.

9. The completion string assembly of claim 1, wherein the inner string comprises an elongated tubular with a diameter smaller than a diameter of the permeable barrier.

10. A completion system, comprising:

a completion string disposed within a borehole in a subterranean formation;

a tubing string disposed within the borehole above the completion string and providing fluid communication from the surface of the formation to the completion string through an internal bore within the tubing string;

a plurality of expandable sealing assemblies, wherein at least a first expandable sealing assembly of the plurality of expandable sealing assemblies is coupled to the tubing string at a first segment and at least a second expandable sealing assembly of the plurality of expandable sealing assemblies is coupled to the tubing string at a second segment;

an isolated annulus formed between the first expandable sealing assembly and the second expandable sealing assembly, wherein the isolated annulus is in fluid communication with the subterranean formation;

a permeable barrier coupled to the tubing string;

a remotely-controllable valve segment of the tubing string, wherein the remotely-controllable valve segment comprises:

an outer tubular coupled between the permeable barrier and the first expandable sealing assembly;

an inner tubular coupled to an inner string at least partially disposed within the permeable barrier, wherein the inner string defines an inner annulus within the completion string, wherein the inner annulus is further defined by the permeable barrier, a lower seal in the second expandable sealing assembly, the inner tubular and the outer tubular, and wherein the permeable barrier comprises a screen that provides an open flow channel between the isolated annulus and the inner annulus;

a port between the isolated annulus and the internal bore, wherein the port provides selective fluid communication between the isolated annulus and the internal bore through the permeable barrier by selective fluid communication between the inner annulus and the internal bore; and a plurality of remotely-controllable valves coupled to the completion string and the tubing string and responsive to at least one downhole trigger condition to provide selective fluid communication between the internal bore and the inner annulus by selectively blocking the port, wherein at least one of the plurality of remotely-controllable valves is responsive to a different at least one downhole trigger condition of the borehole from at least one other of the plurality of remotely-controllable valves.

11. The completion system of claim 10, wherein the at least one downhole trigger condition comprises at least one of a downhole pressure condition and a downhole temperature condition.

12. The completion system of claim 10, wherein the at least one downhole trigger condition comprises at least a downhole pressure condition, and wherein the downhole pressure condition comprises an ambient pressure condition or a surface-applied pressure condition.

13. The completion system of claim 10, wherein the at least one of the plurality of remotely-controllable valves comprises at least one of a pressure sensor and a temperature sensor;

a controller coupled to at least one of the pressure sensor and the temperature sensor; and a valve assembly actuatable by the controller.

14. The completion system of claim 13, wherein the valve assembly comprises:

at least one of a hydraulic pump and an electric motor coupled to the controller; and a sleeve axially movable by one of the hydraulic pump and the electric motor.

15. A method for completing a well within a subterranean formation, comprising:

positioning a tubing string that at least partially defines an internal bore within a wellbore in the subterranean formation, wherein the tubing string comprises an upper tubing string assembly and a lower tubing string assembly;

forming an annulus between the tubing string and the wellbore, the annulus defined on at least one end by at least one of a plurality of expandable sealing assemblies of a remotely-controllable valve segment, wherein at least a first expandable sealing assembly of the plurality of expandable sealing assemblies is at a first segment of the tubing string and at least a second expandable sealing assembly of the plurality of expandable sealing assemblies is at a second segment of the tubing string;

providing, by a screen of a permeable barrier of the remotely-controllable valve segment, an open flow channel between the annulus and an inner annulus, wherein the inner annulus is defined by an inner tubular of the remotely-controllable valve segment coupled to an inner string of the remotely-controllable valve segment, wherein the inner annulus is further defined by the permeable barrier, a lower seal in the second expandable sealing assembly, the inner tubular and an outer tubular that is coupled between the permeable barrier the first expandable sealing assembly;

providing, by a first remotely-controllable valve of the remotely-controllable valve segment, selective fluid communication between a first internal bore of the lower tubing string assembly and the annulus based, at least in part, on at least one of a downhole pressure condition and a downhole temperature condition by selectively blocking a first port of the first remotely-controllable valve positioned between the annulus and the first internal bore; and providing, by a second remotely-controllable valve of the remotely-controllable valve segment, selective fluid communication between a second internal bore of the upper tubing string assembly and the annulus based, at least in part, on a different one of the at least one of the downhole pressure condition of the wellbore and the downhole temperature condition of the wellbore by selectively blocking a second port of the remotely-controllable valve positioned between the annulus and the second internal bore.

16. The method of claim 15, wherein providing selective fluid communication between at least one of the first and the second internal bores of at least one of the lower tubing string assembly and the upper tubing string assembly and the annulus based, at least in part, on the at least one of the downhole pressure condition and the downhole temperature condition comprises actuating at least one of the first and the second remotely-controllable valves in response to the at least one of the downhole pressure condition and the downhole temperature condition.

17. The method of claim 16, wherein actuating the at least one of the first and the second remotely-controllable valves in response to the at least one of the downhole pressure condition and the downhole temperature condition comprises:

measuring at least one of the downhole pressure condition and the downhole temperature condition with at least one of a pressure sensor and a temperature sensor of the at least one of the first and the second remotely-controllable valves;

receiving the measurement at a controller coupled to at least one of the pressure sensor and the temperature sensor; and actuating a valve assembly coupled to the controller based, at least in part, on the received measurement.

18. The method of claim 17, wherein actuating the valve assembly coupled to the controller comprises triggering at least one of a hydraulic pump and an electric motor coupled to the controller to move a sleeve within the first internal bore.

19. The method of claim 18, wherein providing selective fluid communication between at least one of the first and the second internal bores and the annulus comprises providing selective fluid communication between the at least one of the first and the second internal bores and the annulus through a permeable barrier of the tubing string.

20. The method of claim 19, wherein providing selective fluid communication between the at least one of the first and the second internal bores and the annulus comprises providing selective fluid communication between the at least one of the first and the second internal bores and the inner annulus at least partially defined by the inner string of the tubing string and the permeable barrier.

21. The method of claim 16, wherein forming the annulus between the tubing string and the wellbore comprises:

forming an isolated annulus defined on one end by an expandable packer of the plurality of expandable sealing assemblies and on another end by a sump packer of the plurality of expandable sealing assemblies; and actuating at least one of the first and the second remotely-controllable valves in response to at least one of the downhole pressure condition and the downhole temperature condition comprises:

opening the at least one of the first and the second remotely-controllable valves to allow slurry pumped within the at least one of the first and the second internal bores of the tubing string to enter the isolated annulus; and closing the at least one of the first and the second remotely-controllable valves to prevent fluids from the subterranean formation from entering the at least one of the first and the second internal bores of the tubing string.

22. The method of claim 16, wherein forming the annulus between the tubing string and the wellbore comprises forming an annulus that extends to the top of the wellbore; and actuating the at least one of the first and the second remotely-controllable valves in response to at least one of the downhole pressure condition and the downhole temperature condition comprises:

opening the at least one of the first and the second remotely-controllable valves to allow fluid pumped within at least one of the first and the second internal bores of the tubing string to circulate through the annulus to the surface of the subterranean formation; and closing the at least one of the first and the second remotely-controllable valves to engage with a seal assembly.

23. The method of claim 15, wherein providing selective fluid communication between at least one of the first and the second the internal bores of the at least one of the lower tubing string assembly and the upper tubing string assembly and the annulus based, at least in part, on at least one of the downhole pressure condition and the downhole temperature condition comprises actuating at least one of the first or the second remotely-controlled valves in response to the at least the downhole pressure condition, and wherein the downhole pressure condition comprises at least one of an ambient pressure condition or a surface-applied pressure condition.

24. The method of claim 15, wherein positioning the tubing string within the wellbore comprises positioning the tubing string within one of a single cased wellbore and a cased wellbore with a liner.

* * * * *